US010151312B2

(12) United States Patent
Skrynski et al.

(10) Patent No.: US 10,151,312 B2
(45) Date of Patent: Dec. 11, 2018

(54) ELECTRIC PUMP SUPPORTED BY JOURNAL BEARINGS

(71) Applicant: Robert Bosch GmbH, Stuttgart (DE)

(72) Inventors: Evgenij Skrynski, Stuttgart (DE); Marian Kacmar, Ostfildern (DE); Martin Kling, late of, Penzberg (DE); Oliver Laforsch, Stuttgart (DE); Sando Kunath, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/514,108

(22) PCT Filed: Jul. 22, 2015

(86) PCT No.: PCT/EP2015/066750

§ 371 (c)(1),
(2) Date: Mar. 24, 2017

(87) PCT Pub. No.: WO2016/045817

PCT Pub. Date: Mar. 31, 2016

(65) Prior Publication Data

US 2017/0292516 A1 Oct. 12, 2017

(30) Foreign Application Priority Data

Sep. 24, 2014 (DE) ..... 10 2014 219 219

(51) Int. Cl.
*F04C 2/00* (2006.01)
*F04C 2/08* (2006.01)
(Continued)

(52) U.S. Cl.
CPC ..... *F04C 2/084* (2013.01); *F01C 3/08* (2013.01); *F04C 3/085* (2013.01); *F04C 2240/56* (2013.01); *F04C 2240/60* (2013.01)

(58) Field of Classification Search
CPC ..... F04C 15/008; F04C 11/008; F04C 3/08; F04C 3/085; F04C 2240/60; F04C 2/084
(Continued)

(56) References Cited

U.S. PATENT DOCUMENTS 4,878,804 A * 11/1989 Akerman ..... F04D 13/0633 415/111
5,508,575 A * 4/1996 Elrod, Jr. ..... F16C 25/08 310/156.04
(Continued)

FOREIGN PATENT DOCUMENTS

DE 102010040758 3/2012
JP 2001003876 1/2001
(Continued)

OTHER PUBLICATIONS

International Search Report for Application No. PCT/EP2015/066750 dated Sep. 7, 2015 (English Translation, 3 pages).

*Primary Examiner* — Charles Freay
(74) *Attorney, Agent, or Firm* — Michael Best & Friedrich LLP

(57) ABSTRACT

Pump units include a rotatably arranged rotor (3) that is driven by a drive shaft (2), wherein the drive shaft (2) has a first bearing section (18) facing towards the rotor (3), and a second bearing section (19) facing away from the rotor (3). The first bearing section (18) is a first sliding bearing (20), and the second bearing section (19) is a second sliding bearing (21). The load-bearing capacity of the first sliding bearing (20) is limited by a predetermined working pressure in the pump unit. In the pump unit according to the invention, the load-bearing capacity of the sliding bearing (20) facing towards the rotor (3) is increased. According to the invention, the diameter of the first bearing section (18) of the drive shaft (2) and the first sliding bearing (20) is larger than
(Continued)

the diameter of the second bearing section (19) and the second sliding bearing (21).

7 Claims, 1 Drawing Sheet

(51) Int. Cl.
*F04C 3/08* (2006.01)
*F01C 3/08* (2006.01)

(58) Field of Classification Search
USPC ..... 417/410.4
See application file for complete search history.

(56) References Cited

U.S. PATENT DOCUMENTS

2004/0108779 A1* 6/2004 Boettger ..... H02K 5/08 310/89
2005/0220641 A1* 10/2005 Nagata ..... F02M 37/048 417/423.3
2009/0191074 A1* 7/2009 Suzuki ..... F04D 5/002 417/423.7
2010/0104462 A1* 4/2010 Arnold ..... F01C 1/084 418/142
2010/0233000 A1 9/2010 Arnold et al.
2011/0209914 A1* 9/2011 Miyashita ..... H01R 13/6658 174/520
2013/0189142 A1 7/2013 Skrynski
2013/0236312 A1* 9/2013 Simofi-Ilyes ..... F01P 5/04 416/170 R

FOREIGN PATENT DOCUMENTS

WO 2005024237 3/2005
WO 2010047602 4/2010

* cited by examiner

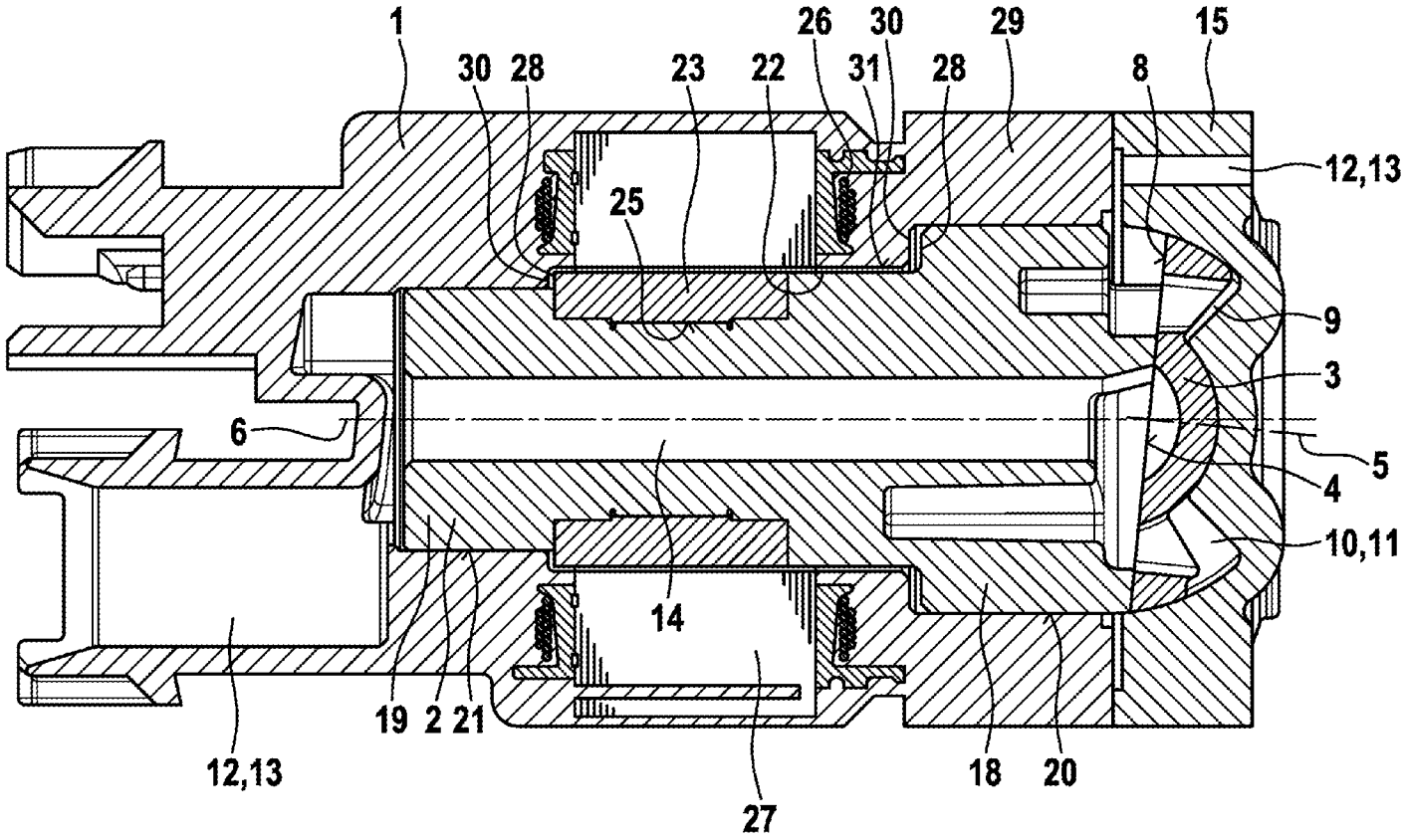
12,13
15
8
29
28
30
31
26
22
23
25
28
30
1
9
3
5
4
10,11
20
18
27
14
21
2
19
6
12,13

ELECTRIC PUMP SUPPORTED BY JOURNAL BEARINGS

BACKGROUND OF THE INVENTION

The invention proceeds from a pump unit.

DE 10 2010 040 758 A1 has already disclosed a pump unit, having a drive shaft and the rotatably arranged rotor which is driven by the drive shaft, the drive shaft having, on an end side, an oblique sliding face which causes the rotor with its rotor axis to tumble about a drive axis of the drive shaft, the drive shaft having a first bearing section which faces the rotor and a second bearing section which faces away from the rotor. The first bearing section of the drive shaft is arranged in a first plain bearing and the second bearing section is arranged in a second plain bearing. During operation of the pump unit, greater forces act on the first plain bearing than on the second plain bearing, since the hydraulic pressure forces which occur in the working chambers of the pump unit act on the drive shaft via the rotor and the oblique sliding face and in the process have to be absorbed predominantly by the first plain bearing. However, the load-bearing capability of the plain bearing which faces the rotor is limited up to a predefined working pressure in the pump unit.

SUMMARY OF THE INVENTION

In contrast, the pump unit according to the invention has the advantage that the load-bearing capability of the first plain bearing which faces the rotor is increased in comparison with the load-bearing capability of the second plain bearing, by the diameter of the first bearing section of the drive shaft and of the first plain bearing being in each case of greater configuration than the diameter of the second bearing section and of the second plain bearing. Moreover, the pump unit can be of shorter construction as viewed in the axial direction of the drive shaft as a result of the configuration according to the invention.

At least one step-shaped shoulder is formed between the first bearing section and the second bearing section as a result of the different diameters of the two bearing sections. As a result, the drive shaft can be demolded particularly easily from an injection molding die of an injection molding machine.

According to one advantageous embodiment, an armature section is provided on the drive shaft between the two bearing sections, which armature section has, on its circumference, permanent magnets which interact with an electric winding of an electric stator of an electric motor which surrounds the armature section of the drive shaft in an annular manner. In this way, an inexpensive electric drive is realized, the armature of which is integrated into the drive shaft.

It is particularly advantageous if the armature section has a diameter which lies in the range between the diameter of the first bearing section and the diameter of the second bearing section. In this way, two step-shaped shoulders are formed between the two bearing sections. As a result of said two-step configuration, the diameter of the armature section can be selected in an optimum manner for each new design in the range between the diameters of the first and the second bearing section. The degree of efficiency of the electric motor can be optimized in a simple way by way of the selection of an optimum ratio of the diameter of the permanent magnets to the external diameter of the electric stator of the electric motor.

It is very advantageous if the first plain bearing and the second plain bearing are arranged in each case on an end side of the stator, since the two plain bearings can be integrated into a circumferential wall of the housing of the pump unit in this way and can be manufactured inexpensively as a result.

Moreover, it is advantageous if two steps are formed in the circumferential wall of the housing between the two plain bearings, which steps separate the two plain bearings from a stator region, since the housing can be demolded particularly easily from an injection molding die of an injection molding machine in this way.

It is advantageous if the stator with its electric winding is integrated into the material of the circumferential wall of the housing of the pump unit, since the stator and its electric winding are sealed with respect to the conveying medium in this way. The sealing action is brought about by the stator being encapsulated by plastic on its end sides and also on its inner and outer circumferential side.

Furthermore, it is advantageous if the stator is arranged in the circumferential wall of the housing between the first plain bearing and the second plain bearing as viewed in the axial direction, since an electric drive with a short axial overall length can be realized in this way.

Moreover, it is advantageous if the circumferential wall of the housing is manufactured from plastic. In this way, the housing can be manufactured very inexpensively in an injection molding process.

BRIEF DESCRIPTION OF THE DRAWING

One exemplary embodiment of the invention is shown in simplified form in the drawing and is explained in greater detail in the following description.

The drawing shows a pump unit according to the invention in section.

DETAILED DESCRIPTION

The pump unit, for example a pump or a compressor, has a housing 1, in which a drive shaft 2 and a rotatably arranged rotor 3 which is driven by the drive shaft 2 are provided. On an end side which faces the rotor 3, the drive shaft 2 has an oblique sliding face 4 which causes the rotor 3 with its rotor axis 5 to tumble during rotation of the drive shaft 2 about a drive axis 6 of the drive shaft 2. On its side which faces the drive shaft 2, the rotor 3 has a sliding face 8 which interacts with the oblique sliding face 4 and, on its end side which faces away from the drive shaft 2, has a toothing section 9 which meshes with a toothing section 10 which is configured, for example, on the housing 1. The oblique sliding face 4 and the sliding face 8 are configured, for example, as planar surfaces. Working spaces 11 are formed between the toothing section 9 of the rotor 3 and the toothing section 10 of the housing 1, which working spaces 11 can be filled via an inlet 12 of the pump unit and can be emptied via an outlet 13 of the pump unit. The toothing section 9 of the rotor 3 and the toothing section 10 of the housing 1 are configured, for example, as a cycloid toothing system, but can also be a different toothing system. The pump unit operates according to the displacement principle, with the result that the fluid is sucked into the working spaces 11 via the inlet 12 in a self-priming manner and is ejected from said working spaces 11 via the outlet 13 at an elevated pressure. The drive shaft 1 has a through channel 14, in order to transport fluid from the inlet 12 into the working spaces 11 or out of the latter to the outlet 13. Which opening 12, 13 of the pump unit is the inlet or the outlet is dependent on the rotational direction of the rotor 3. The section of the housing 1, on which the toothing section 10 is provided, is configured, for example, as a separate housing cover 15 which closes another section of the housing 1 which is, for example, of cylindrical or pot-shaped configuration.

The drive shaft 2 has a first bearing section 18 which faces the rotor 3 and a second bearing section 19 which faces away from the rotor 3, the first bearing section 18 of the drive shaft 2 being arranged in a first plain bearing 20 and the second bearing section 19 being arranged in a second plain bearing 21.

It is provided according to the invention that the diameter of the first bearing section 18 of the drive shaft 2 and of the first plain bearing 20 is in each case of greater configuration than the diameter of the second bearing section 19 and of the second plain bearing 21. As a result, the load-bearing capability of the first plain bearing 20 which faces the rotor 3 is increased. The oblique sliding face 4 adjoins the first bearing section 18 directly on the end side, to be precise in a substantially stepless manner or at least without widening of the diameter of the drive shaft 2.

An armature section 22 is provided on the drive shaft 2 between the first bearing section 18 and the second bearing section 19, which armature section 22 has, on its circumference, permanent magnets 23 which interact with an electric winding 26 of an electric stator 27 which surrounds the armature section 22 of the drive shaft 2 in an annular manner. In this way, an inexpensive electric motor is formed. The stator 27 is formed, for example, by way of an assembly of sheet metal layers made from what is known as electrical sheet which are stacked above one another. The permanent magnets 23 are arranged in at least one seat 25 of the drive shaft 2. The permanent magnets 23 can be individual magnets or can be configured on a single magnetic ring, in the material of which magnetic powder is embedded. For example, the magnetic ring can be manufactured from a plastic as base material, in which the magnetic powder is present in a distributed manner. The permanent magnets 23 which are arranged in the seat 25 can be sealed with respect to the fluid of the pump unit, for example by being covered by an encapsulation (not shown) which can also be a coating. The permanent magnets 23 can be arranged eccentrically on the drive shaft 2 with regard to the stator 27 and as viewed in the direction of the drive axis 6, in such a way that the drive shaft 2 is pressed against the rotor 3 with a predefined magnetic force. To this end, the permanent magnets 23 are arranged on the drive shaft 2 offset in a direction which faces away from the rotor 3 in comparison with a central arrangement with regard to the stator 27.

The armature section 22 of the drive shaft 2 has a diameter which lies in the range between the diameter of the first bearing section 18 and the diameter of the second bearing section 19. In this way, two step-shaped shoulders 28 are formed between the two bearing sections 18, 19 of the drive shaft 2.

The first plain bearing 20 and the second plain bearing 21 are arranged on different sides of the stator 27, for example in each case on one of the end sides. The first plain bearing 20 and the second plane bearing 21 are provided on a circumferential wall 29 of the housing 1 of the pump unit, which circumferential wall 29 faces the drive shaft 2. The circumferential wall 29 of the housing 1 delimits a space for receiving the drive shaft 2. The plain bearings 20, 21 can be formed by way of the circumferential wall 29 itself or can be arranged on the circumferential wall 29 as a separate component, for example as a plain bearing bush. In accordance with the exemplary embodiment, two steps 30 are provided in the circumferential wall 29 of the housing 1 between the two plain bearings 20, 21, which steps 30 separate the two plain bearings 20, 21 from a stator region 31, the diameter of which is configured in such a way that an air gap which is as small as possible results between the armature section 22 of the drive shaft 2 and the stator region 31 of the housing 1.

In accordance with the exemplary embodiment, the electric stator 27 with its electric winding 26 is integrated into the material of the circumferential wall 29 of the housing 1, the stator 27 being arranged in the circumferential wall 29 of the housing 1 between the first plain bearing 20 and the second plain bearing 21 as viewed in the axial direction. The integration of the stator 27 into the circumferential wall 29 of the housing 1 is achieved by the stator 27 with its electric winding 26 being molded into the circumferential wall 29, that is to say being enclosed completely or partially in the material of the circumferential wall 29. To this end, the circumferential wall 29 of the housing 1 is manufactured from plastic and by means of injection molding.

What is claimed is:

1. A pump unit having a drive shaft (2) and a rotatably arranged rotor (3) which is driven by the drive shaft (2), the drive shaft (2) having, on an end side, an oblique sliding face (4) which causes the rotor (3) with a rotor axis (5) to tumble during rotation of the drive shaft about a drive axis (6) of the drive shaft (2), the drive shaft (2) having a first bearing section (18) and a second bearing section (19) which is farther from the rotor (3) than the first bearing section (18), the first bearing section (18) being arranged in a first plain bearing (20), and the second bearing section (19) being arranged in a second plain bearing (21), characterized in that the diameter of the first bearing section (18) and the diameter of the first plain bearing (20) are respectively greater than the diameter of the second bearing section (19) and the diameter of the second plain bearing (21), wherein an armature section (22) is provided on the drive shaft (2) between the first bearing section (18) and the second bearing section (19), wherein the armature section (22) has, mounted on a circumference of the armature section, permanent magnets (23) that interact with an electric winding (26) of an electric stator (27) which surrounds the armature section (22), wherein the first plain bearing (20) and the second plain bearing (21) are arranged on a circumferential wall (29) of a housing (1) of the pump unit, wherein the stator (27) is arranged in the circumferential wall (29) of the housing (1) between the first plain bearing (20) and the second plain bearing (21) as viewed in the axial direction, and wherein the diameter of the first bearing section is greater than a diameter of any other section of the drive shaft.

2. The pump unit as claimed in claim 1, characterized in that the armature section (22) has a diameter which lies in a range between the diameter of the first bearing section (18) and the diameter of the second bearing section (19).

3. The pump unit as claimed in claim 1, characterized in that the first plain bearing (20) and the second plain bearing (21) are each arranged on an end side of the stator (27).

4. The pump unit as claimed in claim 1, characterized in that two steps (30) are provided in the circumferential wall (29) of the housing (1) between the two plain bearings (20, 21), which steps (30) separate the two plain bearings (20, 21) from a stator region (31).

5. The pump unit as claimed in claim 1, characterized in that the stator (27) with the electric winding (26) is integrated into the material of the circumferential wall (29) of the housing (1).

6. The pump unit as claimed in claim 1, characterized in that the circumferential wall (29) of the housing (1) is manufactured from plastic.

7. The pump unit as claimed in claim 1, characterized in that the drive shaft (2) is a single piece.

* * * * *